United States Patent [19]

Okuya

[11] Patent Number: 4,698,613

[45] Date of Patent: Oct. 6, 1987

[54] CLICK MECHANISM OF SLIDE VOLUME CONTROL

[75] Inventor: Tsutae Okuya, Miyage, Japan

[73] Assignee: Alps Electric Co., Ltd., Japan

[21] Appl. No.: 900,498

[22] Filed: Aug. 26, 1986

[30] Foreign Application Priority Data

Aug. 30, 1985 [JP] Japan ..... 60-131728[U]

[51] Int. Cl.[4] ..... H01C 10/38

[52] U.S. Cl. ..... 338/176; 200/16 C; 338/202; 338/198; 338/199; 338/200

[58] Field of Search ..... 338/176, 179, 183, 184, 338/188, 194, 198, 199, 200, 171; 200/16 C, 16 D, 290, 291

[56] References Cited

U.S. PATENT DOCUMENTS

| | | | |
|---|---|---|---|
| 3,270,149 | 8/1966 | O'Shea et al. | 200/16 C |
| 3,271,535 | 9/1966 | Vananzi | 200/16 C |
| 3,311,719 | 3/1967 | Vananzi | 200/16 C |
| 3,312,925 | 4/1967 | Frantz | 338/200 |
| 3,355,565 | 11/1967 | Daul | 200/16 C |

*Primary Examiner*—C. L. Albritton

*Attorney, Agent, or Firm*—Guy W. Shoup

[57] ABSTRACT

A click mechanism of slide volume control ensures judgement of a center stop position of a lever by a difference in the click touches and allows many stop positions of the lever by providing holes on both sides of the lever inserting hole of the upper surface plate of the frame and providing convex portions on the ends of elastic arms of a plate spring which engage the holes.

7 Claims, 8 Drawing Figures

CLICK MECHANISM OF SLIDE VOLUME CONTROL

BACKGROUND OF THE INVENTION

The present invention relates to a click mechanism of slide volume control.

As a conventional click mechanism of slide volume control which stops the lever with a click touch in a plurality of positions as the lever slides, a structure has a plurality of holes of the same size formed in the surface along one direction of a frame slidably accommodating a slider receptacle and a ball which can be engaged with said holes is provided with the slider receptacle. However, the conventional click mechanism is inferior in general purposes because it cannot respond to the requirement, for example, to judge the central stop position from a difference in the click touches since the spring force is always constant and the size of the holes is the same and thereby all click touches become the same, and also cannot respond to the requirement to set more stop positions between the holes in which the ball is engaged.

SUMMARY OF THE INVENTION

The present invention solves such inconvenience of the prior art and therefore it is the object of the present invention to provide a click mechanism of a slide type volume control which can satisfy at least either one of the following two requirements that the central stop position of lever must be judged from a difference of click touches and more stop positions of the lever must be provided.

In order to attain such object, the present invention has a characteristic that holes are formed on both sides of the lever inserting hole of the upper surface plate of a frame and simultaneously a slider has convex portions which can be engaged with said holes provided at the end portions of elastic arms of a plate spring and thereby the central stop position of lever can be judged easily and more stop positions of the lever can be set.

BRIEF DESCRIPTION OF THE DRAWINGS

The click mechanism of slide volume control will be discussed in detail with respect to the accompanying drawings in which.

DETAILED DESCRIPTION OF THE PREFERRED EMBODIMENT

Figure 5:
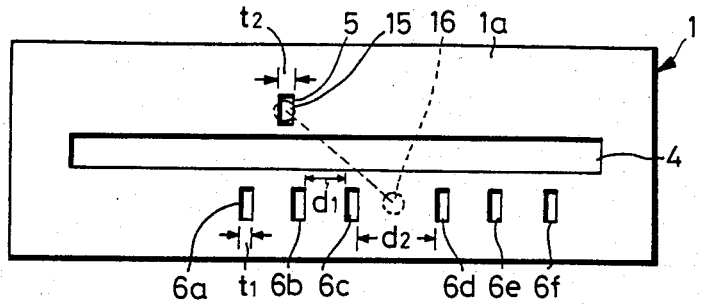
FIG. 5 is an explanatory view of the click operation a slide lever viewed from the top of the frame.

In FIG. 1 to FIG. 5, numeral 1 represents a frame; 2, a slider receptacle accommodated slidably in said frame 1; 3, a lever integrally formed with said slider receptacle. This lever is protruded upward from a lever insertion hole 4 provided in the upper surface plate 1*a* of the frame 1. Numeral 5 represents a hole for determining the central position of lever 3 provided to the one side of the lever inserting hole 4 in the upper surface plate 1*a* of the frame 1; 6*a*, 6*b*, 6*c*, 6*d*, 6*e*, 6*f* represent the holes for determining the other stop positions formed in a line on the other side of the hole 4. The width $t_1$ of the holes 6*a*–6*f* indicated in FIG. 5 is the same but is narrower than the width $t_2$ of hole 5. The width $d_1$ between the holes 6*a* and 6*b*, between the holes 6*b* and 6*c*, between the holes 6*d* and 6*e*, between the holes 6*e* and 6*f* is the same but the width $d_2$ between holes 6*c* and 6*d* is set wider than the width $d_1$.

Figure 1:
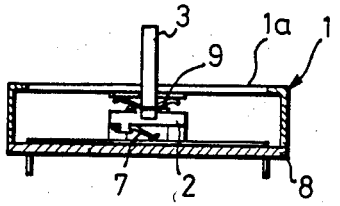
FIG. 1 is a vertical elevation in section of one embodiment of the invention.
Figure 3A:
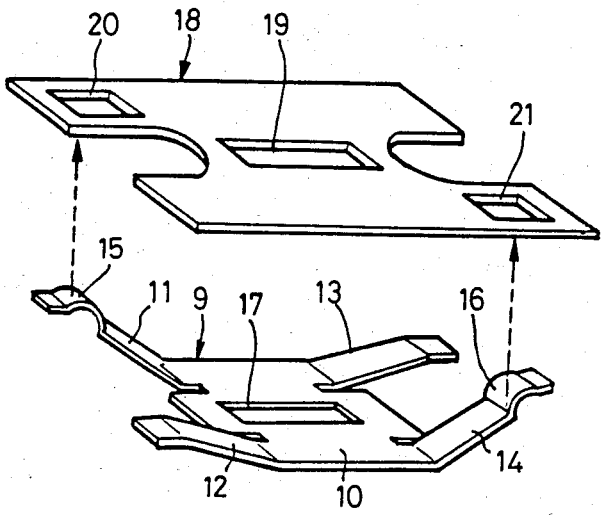
FIG. 3A shows disassembled perspective views of a touch plate and a plate spring.
Figure 2:
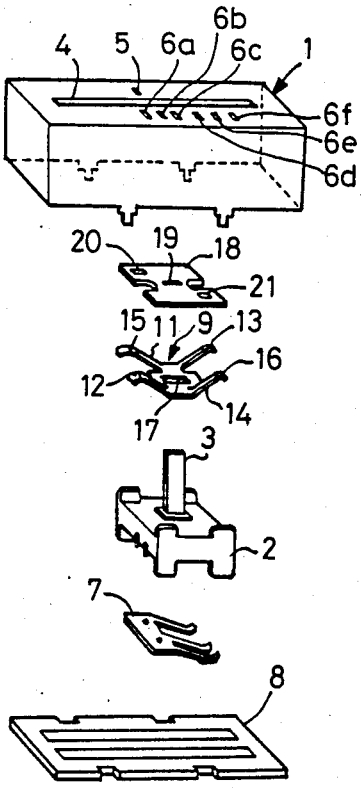
FIG. 2 is a disassembled perspective view of essential part.
Figure 3B:
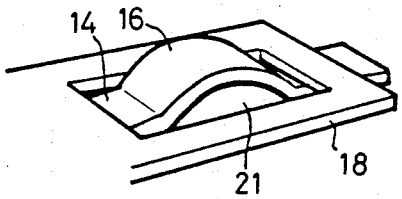
FIG. 3B is a partial perspective view of such touch plate and plate spring assembled together.
Figure 4:
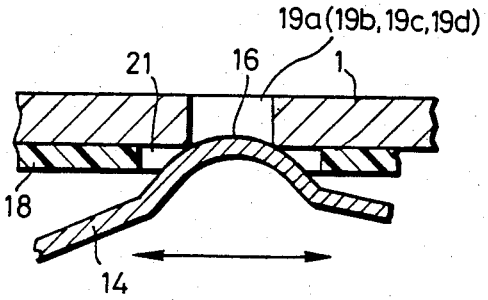
FIG. 4 is a sectional view illustrating the essential part of the click mechanism.

Returning to FIGS. 1 and 2, numeral 7 represents a slider fixed on the opposite side of the protruded surface of the lever 3 of the slider receptacle 2; 8, a resistance body substrate; 9, a plate spring. As shown in FIG. 3A, the plate spring has a flat part 10 and elastic arms 11, 12, 13, 14 extended in the four directions from said flat part 10. Two elastic arms 11, 14 opposing obliquely each other are provided with circular convex portions 15, 16 which are removably engaged with the holes 5, 6*a*–6*f* of the upper surface plate 1*a* of said frame 1. Numeral 18 denotes a touch plate consisting of an insulated sheet, provided with a lever inserting hole 19 at the center thereof and the holes 20, 21, from which the convex portions 15, 16 of said plate spring 9 are exposed, on the diagonal lines. Said plate spring 9 and touch plate 18 are provided at the upper surface of slider receptacle 2 by inserting the lever 3 into the center hole 17 of flat part 10 and the hole 19 of touch plate 18. The elastic arms 12, 13 of plate spring 9 are pressed against the touch plate 18. The convex portions 15, 16 of the other elastic arms 11, 14 are protruded from the holes 20, 21 of the touch plate 18 as shown in FIG. 3B and are pressed against the upper surface plate 1*a* of the frame. The touch plate 18 is pressed against the upper surface plate 1*a* of frame 1 and the slider 7 to the resistance body substrate 8 by said plate spring 9.

Regarding the relation between the convex portions 15, 16 of elastic arms 11, 14 of plate spring 9 and the holes 5, 6*a*, . . . 6*f* provided to the upper surface plate 1*a* of said frame 1, as shown in FIG. 5, when the convex portion 15 of the one elastic arm 11 is engaged with the hole 5, the convex portion 16 of the other elastic arm 14 is set to stop at the intermediate position between the hole 6*c* and the hole 6*d*.

Here, the click operations are explained. When the lever 3 moves to the left from the condition of FIG. 5, the convex portion 16 of the elastic arm 14 is sequentially engaged with the holes 6*c*, 6*b*, 6*a*. Meanwhile, the convex portion 15 of elastic arm 11 escapes from the hole 5 and slides on the upper surface plate 1*a* of the frame 1.

When the convex portion 16 engages with the hole 6*c* and the lever 3 is moved to the right from the condition where the convex portion 15 is located on the upper surface plate 1*a*, the condition returns to the initial state of FIG. 5. The same click operation is also carried out when the lever 3 is moved to the right from the condition of FIG. 5.

According to the embodiment of the present invention, since the width $t_2$ of the hole 5 for determining the center stop position is set wider than the width $t_1$ of the other holes 6*a*–6*f* for determining positions, the click touch changes when the lever 3 is located at the center than at the other positions and therefore the condition where the lever 3 is located at the center position can be quickly detected.

Figure 6:
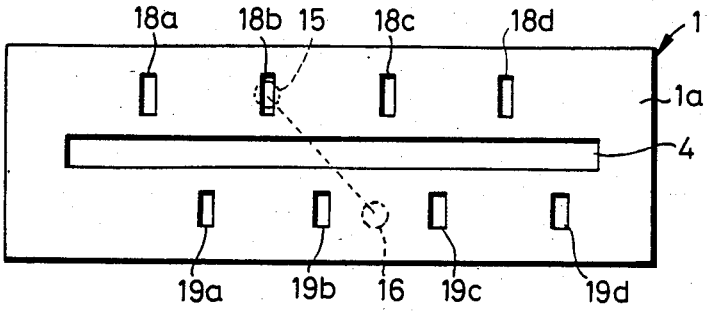
FIG. 6 and FIG. 7 show another embodiment of the present invention.

FIG. 6 shows another embodiment of the present invention, wherein the holes 18*a*–18*d* are provided in a line with equal intervals on one side of the lever inserting hole 4 of the upper surface plate 1*a* of frame 1, and holes 19*a*–19*d* with equal intervals on the other side of such lever inserting hole 4. These holes are provided with a spacing deviation so that the hole 18*b* is located at the intermediate portion of the holes 19*a* and 19*b*, and when the convex portion 15 of elastic arm 11 of plate spring 9 is engaged with the hole 18*b*, the convex portion 16 of the other elastic arm 14 is located at the intermediate part of the holes 19*b* and 19*c*.

In this case, the convex portions 15, 16 alternately engage with the holes 18*a*–18*d* and the holes 19*a*–19*d*, and many stop positions can be secured while suppressing a drop of intensity resulting from provision of the holes 18*a* 18*d*, 19*a* 19*d*.

Figure 7:
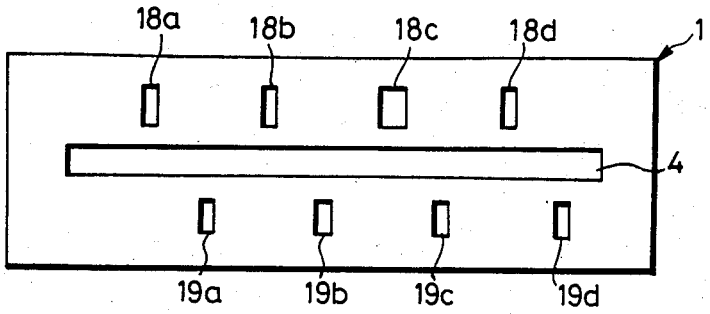

Moreover, as shown in FIG. 7, when the width of hole 18*c* is set wider than the width of the other holes, many stop positions of lever 3 can be obtained and a difference can be given to the click touch of lever 32.

According to the present invention, difference can be given to the click touch of lever, as desired, by providing the holes in both sides of the lever inserting hole of the upper surface plate of the frame and providing the convex portions which can be removably engaged with said holes on the end portions of the elastic arms of the plate spring. Moreover, the click mechanism which can be used for general purposes can be attained, namely many stop positions of the lever can be obtained with the same click touch as desired and in addition many stop positions of lever can be ensured and a difference is also given to the click touch, as required.

What is claimed is:

1. A click mechanism of a slide lever control, comprising:

a frame having a surface provided with an elongated center hole, at least one stop hole on one side of said center elongated hole, and a plurality of stop holes formed in two sets on the other side of said center elongated hole;

a plate spring having an elastic arm formed on each of two sides thereof;

a slide lever mounted with said plate spring on a slider receptacle slidably disposed in said frame with said slide lever protruding from said center elongated hole of said frame and said elastic arms of said plate spring extending toward and engageable with the stop holes on the respective sides of said frame, wherein said one stop hole on said one side of said frame is located such that the elastic arm on one side of said plate spring engages said stop hole to define a center stop position between the two sets of stop positions defined by said two sets of stop holes on the other side of said frame engageable with the elastic arm on the other side of the plate spring, whereby a difference in the click touch of said center stop position from the other stop positions can be detected.

2. A click mechanism according to claim 1, wherein said elastic arms have respective convex portions on their ends which engage in said stop holes.

3. A click mechanism according to claim 1, wherein said hole on said one side of said frame is located such that when the elastic arm on said one side is engaged in said stop hole, the elastic arm on said other side is disposed on the surface of said frame between said two sets of stop holes on said other side of said frame.

4. A click mechanism according to claim 1, wherein said one side of said frame has a plurality of stop holes including said stop hole defining said center stop position.

5. A click mechanism according to claim 1, wherein said stop hole defining said center stop position has a width larger than the width of the other stop holes, whereby a difference in the click touch of the elastic arm in said one hole at said center stop position from the other stop positions can be detected.

6. A click mechanism of a slide lever control, comprising:

a frame having a surface provided with an elongated center hole, at least one stop hole on one side of said center elongated hole, and a plurality of stop holes formed on the other side of said center elongated hole;

a plate spring having an elastic arm formed on each of two sides thereof, wherein the elastic arms have convex portions formed on the ends thereof;

a touch plate mounted to said plate spring having holes therein through which the convex portions of said elastic arms of said plate spring protrude;

a slide lever mounted with said plate spring and said touch plate on a slider receptacle slidably disposed in said frame with said slide lever protruding from said center elongated hole of said frame, and said elastic arms of said plate spring extending through said holes of said touch plate toward and engageable with the stop holes on the respective sides of said frame in order to define respective stop positions of said slide lever.

7. A click mechanism of a slide lever control, comprising:

a frame having a surface provided with an elongated center hole, at least one stop hole on one side of said center elongated hole, and a plurality of stop holes formed on the other side of said center elongated hole;

a plate spring having an elastic arm formed on each of two sides thereof;

a slide lever mounted with said plate spring on a slider receptacle slidably disposed in said frame with said slide lever protruding from said center elongated hole of said frame and said elastic arms of said plate spring extending toward and engageable with the stop holes on the respective sides of said frame in order to define respective stop positions of said slide lever, wherein said stop hole on said one side defines a predetermined stop position of said slide lever by means of having a width larger than the width of the other stop holes, whereby a difference in the click touch of the elastic arm in said one hole at said predetermined stop position from the other stop positions can be detected.

* * * * *